United States Patent [19]

Kurita et al.

[11] 3,965,524

[45] June 29, 1976

[54] RESIDUAL TONER REMOVING APPARATUS

[75] Inventors: Takaji Kurita, Kawachinagano; Takao Fujiwara, Sakai, both of Japan

[73] Assignee: Minolta Camera Kabushiki Kaisha, Osaka, Japan

[22] Filed: Feb. 19, 1974

[21] Appl. No.: 443,524

[30] Foreign Application Priority Data

Feb. 24, 1973 Japan ..... 48-22398

[52] U.S. Cl. ..... 15/308; 355/15

[51] Int. Cl.[2] ..... A47L 5/38

[58] Field of Search ..... 15/1.5, 256.52, 308; 118/637; 355/15

[56] References Cited

UNITED STATES PATENTS

| | | | |
|---|---|---|---|
| 2,751,616 | 6/1956 | Turner et al. | 15/308 X |
| 2,832,977 | 5/1958 | Walkup et al. | 15/1.5 |
| 3,795,025 | 3/1974 | Sadamitsu | 15/256.52 |

*Primary Examiner*—Billy J. Wilhite
*Assistant Examiner*—C. K. Moore
*Attorney, Agent, or Firm*—Wenderoth, Lind & Ponack

[57] ABSTRACT

A residual toner removing apparatus comprises a rotatable cleaning brush enclosed by a casing plate and a restriction board except for two gaps housed in a housing with an opening adjacent to a known photoreceptor surface. During rotation, brush hairs contact the casing plate to charge it with an opposite polarity to that of the toner particles, while the brush hairs are compressed by the restriction board, the cleaning brush thus acting like a fan for circulation of air and entrained toner particles, during which circulation lighter toner particles are attracted by the casing plate with heavier particles falling into catchment portions on the casing and well portions at lower parts of the housing for efficient removal of toner particles without separate vacuum means.

20 Claims, 3 Drawing Figures

RESIDUAL TONER REMOVING APPARATUS

BACKGROUND OF THE INVENTION

The present invention relates to a dry-copying process photo-copying apparatus, and more particularly to a unitary residual toner removing apparatus for use therein.

Commonly, in photographic copying by xerographic or similar techniques, subsequent to projection of a light image of an original to be reproduced onto a charged photosensitive photoreceptor surface to form an electrostatic latent image thereon, the latent image is developed by the toner powder to produce an electroscopic toner powder image in the configuration of the latent image on the photosensitive surface for transfer onto a copy-paper sheets so as to obtain a copy of the original image thereon. After completion of the transfer, the toner powder still remaining on the photosensitive surface must be completely removed for reuse of the photosensitive surface as is known in the art. A conventional means for removal of residual toner comprises a rotatable brush, which, in a copying apparatus, is located adjacent to the path along which the photosensitive surface is fed, which may contact the photosensitive surface, and which is associated with a vacuum-producing means and a filter bag or similar means for reception of removed toner particles. The brush is rotated at a high speed, thereby loosening and removing toner particles from the photosensitive surface, and these loosened particles are withdrawn by the vacuum means into the reception bag. Such conventional means are efficient in the removal of residual toner particles from the photophotosensitive surface, but have the disadvantage of bulkiness, because of the necessity for the provision of ducts, separate vacuum-producing means, and a bag, which makes it difficult to provide a compact copying apparatus. Other disadvantages of conventional toner removing means are that provision of a vacuum-producing means raises initial expense of the copying apparatus, and makes maintenance thereof more difficult, and that production of a vacuum raises power requirements, and hence the price per copy obtained.

SUMMARY OF THE INVENTION

It is accordingly an object of the present invention to provide an improved residual toner removing apparatus.

It is another object of the present invention to provide a residual toner removal apparatus which is compact and which operates efficiently without complex associated equipment.

It is a further object of the present invention to provide a residual toner removing apparatus having low power requirements.

It is a still further object of the present invention to provide a residual toner removing apparatus that is simple in construction and easy to maintain.

In accomplishing these and other objects, there is provided, according to the present invention, a residual toner removing apparatus contained within a single compact housing, wherein there is provided a rotatable brush which may contact a photosensitive surface through an open portion of a housing wall, a certain portion of the periphery of which is enclosed by a casing and another, smaller part of the periphery of which is compressed by a restriction board, there being gaps between opposite ends of the casing and restriction board. Being rotated at a high speed, the brush acts in a manner similar to that of a fan, and air is drawn in through one of the gaps, and air, together with toner particles which have been removed from the photosensitive surface and carried away therefrom by the brush, is expelled through the other gap. The restriction board serves the function of compressing the brush to further drive air into this outlet gap. Since these gaps communicate with the interior of the main housing, air circulates within the housing, and carries freed toner particles. Frictional contact of the brush results in an electrical charge on the casing, which charge may be supplemented by an external voltage supply, and the casing attracts the toner particles, which adhere to the casing and subsequently move under gravity to reception portions attached to the casing, or simply formed by the lower part of the housing, while clean air is again drawn into the first gap due to the fan-like action of the brush. In another embodiment of the invention, there is provided within the housing a belt on which an electrical charge is imposed, which belt is driven along a path following the outer contour of the casing, and from which adhering toner particles are removed by a wiper means provided at a suitable location along the belt. In all embodiments of the invention, the toner removing means is a single unit contained in a compact housing, and the only power requirements are power for driving the brush, and, optionally, a supplementary voltage source.

BRIEF DESCRIPTION OF THE INVENTION

A better understanding of the present invention may be had from the following full description, when read in conjunction with the attached drawings. In the drawings, throughout which like numerals refer to like parts, FIG. 1 is a schematic cross-sectional view of a residual toner removing apparatus according to a first embodiment of the invention;

FIG. 2 is a schematic cross-sectional view of a modification of the residual toner removing apparatus of FIG. 1; and FIG. 3 is a schematic cross-sectional view of a residual toner removing apparatus according to a second embodiment of the invention.

DETAILED DESCRIPTION OF THE INVENTION

Figure 1:
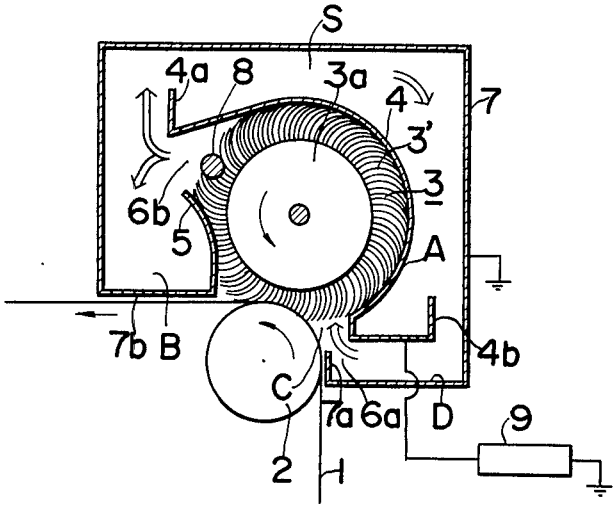

Referring to FIG. 1, there is shown a roller 2 driven by a conventional means, which is provided in a copying apparatus for the transport of a known photosensitive photoreceptor 1. Rotation of the roller 2 (counterclockwise in the drawing) moves the photosensitive photoreceptor 1, for example, in the form of an endless belt or a drum through various processing stations. After completion of transfer of an image of an original onto a copy-paper sheet, the portion of the photoreceptor surface 1 bearing the toner powder image formed thereon through charging, exposure, and development processes is further carried on the roller 2 to a position facing a cleaning brush 3 for removing the residual toner particles from the photoreceptor surface 1, these or other processes being effected in a known manner in the copying apparatus, which may be conventional, apart from the provision of the residual toner removing apparatus of the invention. The cleaning brush 3 is constituted by a rotatary drum 3*a*, which is rotatable counterclockwise, and around the entire outer periphery of which there are attached hairs 3′, which may be rabbit or other animal fur, or synthetic textile fibres, such as acrylnitrile, for example. The roller 2 is located below the cleaning brush 3, the distance between the outer peripheries of the roller 2 and rotatory drum 3*a* being somewhat less than the length of the brush hairs 3', whereby, upon rotation of the drum 3*a*, the photosensitive surface 1 on the upper portion of the roller 2 is brought into good contact with the brush hairs 3' at the lower part of the brush 3. The cleaning brush 3 is partially enclosed in a casing 4, which is provided in a housing 7.

The casing plate 4 is made of an electrically conductive material, and comprises a main section A, which substantially forms a semi-circle parallel to the outer periphery of the top and rear (top and right in the drawing) portion of the drum 3*a*, and is removed therefrom by a distance approximately equal to or slightly less than the extended length of the brush hairs 3', whereby, on rotation of the drum 3*a*, brush hairs 3' contact the inside of the casing main portion A, but are not compressed thereby. The upper forward part of the casing main section A leads away from the brush 3, inclines downwards slightly, and is integral with a generally L-shaped catchment portion 4*a*. The lower, rear part of the casing main portion A is integral with a generally U-shaped catchment portion 4*b*. The catchment portions 4*a* and 4*b* are for the reception of toner particles, as described in further detail below. During rotation of the brush 3, the casing 4 is charged electrically with opposite polarity to the toner particles due to frictional electricity caused by contact of the brush hairs 3'. There may also be provided an external voltage supply 9, which charges the casing 4 to a comparatively higher voltage with opposite polarity to the toner particles. The housing 7 is electrically isolated from the casing 4, and is preferably grounded. The casing 4 extends across the width of the housing 7, thus enclosing the brush 3 laterally, but does not cover the front and lower portions of the brush 3.

The housing 7 encloses the casing plate 4 and brush 3 except for a contact gap C, through which the brush 3 may contact the photoreceptor surface 1, and comprises a generally box-like main top portion which encloses but does not contact the casing plate 4 and front side of the brush 3. The rear wall of the housing 7 extends to below the level of the bottom of the brush 3, and connects with a horizontal wall which extends forwards to the vicinity of the roller 2, and connects with a short, upwardly extending wall 7*a*. The lower, rear portion of the housing 7 thus forms a well-shaped portion D, which is larger than, lies below and is not in contact with the catchment portion 4*b*. Between the housing wall 7*a* and catchment portion 4*b* there is a small gap over which the brush 3 is not covered and which constitutes an air inlet gap 6*a*, as described below.

The bottom end of the front wall of the housing 7 connects with a horizontal wall 7*b*, which extends rearwards therefrom, i.e., towards the brush 3, at a level slightly above the bottom part of the brush 3, and connects with a restriction board 5. The restriction board 5 extends upwards and curves slightly away from the brush 3, whereby there is formed a well portion B at the lower front of the housing 7. The greater portion of the restriction board 5 is separated from the outer periphery of the lower, front portion of the drum 3*a* by a distance that is rather less than the length of the brush hairs 3', whereby brush hairs 3' contacting the restriction board 5 may not extend radially to their full length from the drum 3*a*, but are compressed somewhat. The restriction board does not extend as far as the catchment portion 4*a*, whereby between the top edge of the restriction board 5 and the catchment portion 4*a* there is formed a gap, which is somewhat wider than the inlet gap 6*a*, and which serves as an air and toner particle outlet gap 6*b*, as described below. A bar 8, which extends across the width of the housing 7, and is fixedly supported in the housing side walls, not shown, is located in a generally central portion of the air outlet gap 6*b*. The distance of the bar 8 from the outer periphery of the drum 3*a* is less than the length of the brush hairs 3'. The abovementioned contact gap C is formed between the housing wall 7*a* and the junction of the housing wall 7*b* and the restriction board 5, and is mainly covered by the portion of the roller 2 lying in the vicinity of the brush 3 and by the photoreceptor 1 transported by the roller 2.

Operation of the abovedescribed apparatus is as follows. The portion of the photoreceptor surface 1, wherefrom the toner powder image has been transferred to a copypaper sheet, but on the surface of which there are still remnant toner particles, is brought by the roller 2, which rotates counterclockwise at a moderate speed, into the contact gap C of the residual toner removing apparatus, and is there contacted by the brush hairs 3' on the drum 3*a*, which is also rotated counterclockwise, but at high speed. Brush hairs 3' therefore wipe off the remnant toner particles from the surface of the photoreceptor surface 1, and carry the particles past the air inlet gap 6*a*, to that portion of the brush 3 contacted by the casing main portion A. Meantime, cleaned photoreceptor surface 1 is moved to the next stage. When the brush hairs 3' pass over the approximate semi-circle formed by the casing main portion A, since the drum 3*a* is being rotated at high speed, the brush hairs 3' tend to straighten out, becoming rather like the vanes of a fan, and the toner particles are carried along in the air between the brush hairs 3', to the air outlet gap 6*b*. At the same time, as noted earlier, contact of the inside of the main casing portion A by the brush hairs 3', which tend to extend radially outwards with respect to the drum 3*a*, due to centrifugal force, produces frictional electricity, thus imparting a charge with a polarity opposite to that of toner particles on the casing 4, which charge may be supplemented by the voltage supply 9.

When the brush hairs 3' reach the air outlet gap 6*b*, the entrained air and toner particles tend to move outwards, due to centrifugal force, through the outlet gap 6*b*. Upon reaching a central portion of the outlet gap 6*b*, the brush hairs 3' strike against the bar 8, which shakes loose any toner particles attached to the brush hairs 3', and causes a turbulent air flow, which, combined with the effects of centrifugal force, carry the toner particles away from the brush 3. After passing the outlet gap 6*b*, the brush hairs 3' come into contact with the restriction board 5, and after passing the location of the restriction board 5, again come into contact with the photoreceptor surface 1 transported by the roller 2, and then repeat the abovedescribed circuit. While contacting the restriction board 5, the brush hairs 3' are compressed, and air still contained between the brush hairs 3' is driven therefrom, upwards into the outlet gap 6*b*. Thus, while the drum 3*a* is rotating, air, and toner particles, are continually expelled through the outlet gap 6*b*. As indicated by the arrows in FIG. 1, air that has passed through the outlet gap 6*b*, tends to follow a path through the upper portion of the housing 7, over the top of the casing 4, then flows downwards, passing the catchment portion 4*b*, to the lower rear portion of the housing 7, and then upwards through the air inlet gap 6*a*, and enters the area between the outer periphery of the drum 3*a* and the inside of the casing main portion A. Since brush hairs 3′ extend over the entire outer periphery of the drum 3*a*, and since the drum 3*a* rotates at high speed, air naturally tends to be drawn through the gap 6*a*, which is small, into contact with the brush 3, and so remains within the housing 7, rather than leaving through any incompletely closed portions of the contact gap C. The air continuously expelled through the outlet gap 6*b*, into an otherwise enclosed space further ensures that air passes through the inlet gap 6*a* towards the brush 3, and not in the opposite direction and maintains pressure tending to prevent toner particles that have just been removed from the surface of the photoreceptor 1 from moving out of contact with the brush 3. During continued high-speed rotation of the brush 3, air circulates continually on the abovedescribed path.

Toner particles which are expelled through the outlet gap 6*b*, together with air, fall into the well portion B of the housing 7, if comparatively large and heavy, or are carried by the circulating air towards the air inlet 6*a*, if finer and lighter. These lighter particles are attracted to the outer side of the casing 4 charged with the opposite polarity to the toner particles. Some of the particles gather in the inside angle portion of the L-shaped catchment portion 4*a* at the top of the casing 4, but the majority gather in the large catchment portion 4*b*, either by sliding down the outer surface of the casing 4, or being attracted directly thereinto from the circulating air, whereby clean air is supplied through the inlet 6*a*. The voltage supply 9 is not essential, since high speed rotation of the brush 3 results in a sufficient attractive charge on the casing 4. However, provision of the voltage supply greatly enhances the efficiency of the toner removing apparatus. At suitable intervals, the housing 7 is removed, and toner particles emptied from the well portion B, and the catchment portions 4*a* and 4*b*.

Figure 2:
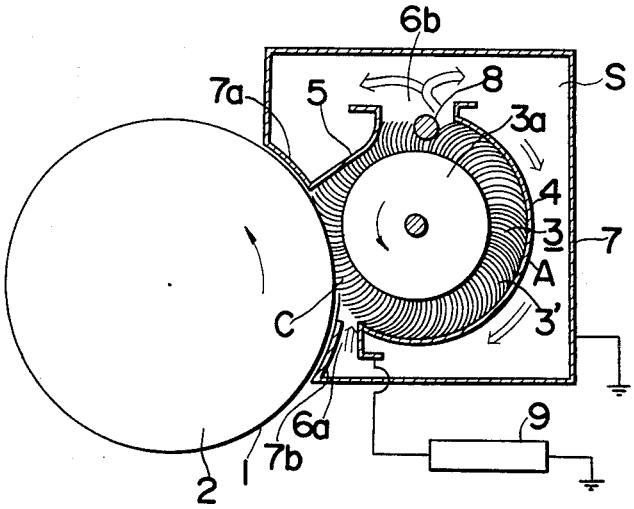

Referring to FIG. 2, there is shown a modification of the first embodiment of FIG. 1. In this modification, the contact gap C is formed at the front wall of the housing 7. Above and below the contact gap C the front wall of the housing 7 forms portions 7*a* and 7*b* which follow the arc of an imaginary circle concentric with the roller 2. The roller 2 is positioned so that part of its periphery is close to the front wall portions 7*a* and 7*b*, whereby the photoreceptor surface 1 is brought into good contact with the brush 3′. The restriction board 5 connects at one end of the wall portion 7*a*, the main portion thereof contacting an upper front portion of the brush 3, and the other end thereof forming a portion bending away from the brush 3. The main portion A of the casing 4 contacts the rear and lower portions of the brush 3, and opposite ends thereof form portions which are bent away from the brush 3, and which are separated from the housing front wall portion 7*b* and the top of the restriction board 5 by the inlet gap 6*a* and outlet gap 6*b* respectively. The modification of FIG. 2 functions in the same manner as the first embodiment described above, and is efficient in ensuring that toner particles remain within the housing 17, since the roller 2 and the photoreceptor surface 1 thereon lie close to the housing 7 over a large arc, constituted by the wall portions 7*a* and 7*b* and the contact gap C.

Figure 3:
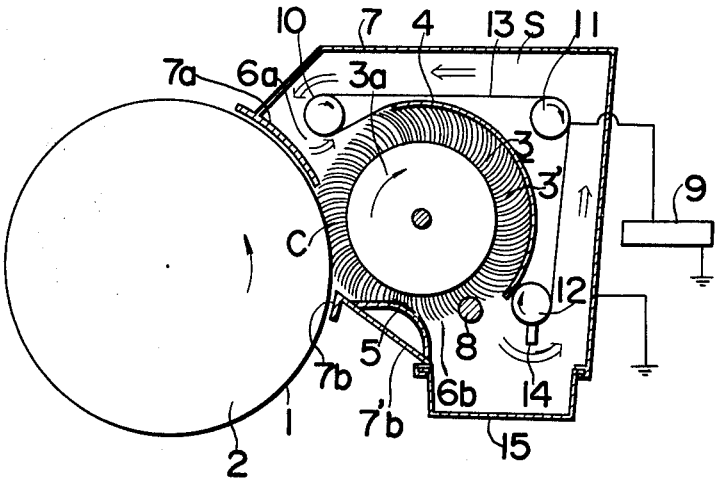

Reference is now made to a second embodiment of the invention shown in FIG. 3. In this second embodiment, the catchment portions 4*a* and 4*b* of the casing 4 are dispensed with, and the casing 4 is simply constituted by a single portion lying parallel to the upper and rear portions of the outer periphery of the drum 3*a*, and just contactable by the brush hairs 3′. The front wall of the main housing 7 forms upper and lower portions 7*a* and 7*b*, which lie on an arc of an imaginary circle concentric with the roller 2, and between which there is formed a contact gap C, wherein the photoreceptor surface 1 in the roller 2 may be contacted by brush hairs 3′, the roller 2 being mounted with a portion of the periphery thereof in close proximity to the housing front wall portions 7*a* and 7*b*. The restriction board 5 is provided on the inside of the housing front wall lower portion 7*b*′, and contacts the lower front portion of the brush 3. Neither the housing front wall portion 7*a* nor the restriction board 5 contact the casing 4, whereby there are formed upper and lower gaps 6*a* and 6*b* over which the brush 3 is not covered in the housing 7. The bar 8 is mounted in a generally central portion of the lower gap 6*b*.

In the second embodiment, the direction of rotation of the brush 3 is clockwise, opposite to that of the first embodiment, that is, the roller 2 and brush 3 are rotated in directions opposite to each other, whereby the air inlet gap 6*a* is formed at the upper front portion of the brush 3 (between the top, front end of the casing 4 and the housing front wall portion 7*a*), the outlet gap 6*b* is formed at a lower portion of the brush 3 (between the lower end of the casing 4 and the restriction board 5), and air, carrying toner particles removed from the photoreceptor surface 1, follows a path from the lower part of the brush 3, upwards through a rear portion of the main housing 7, across the top portion of the housing 7, to the inlet gap 6*a*.

The casing 4 in this embodiment is not necessarily electrically conductive and on the outside thereof, but within the housing 7, there is provided a broad, continuous belt 13, which is generally equal in width to the casing 4, and is made of electrically conductive material. Suitable materials for the belt 13 are, for example, aluminium or other metallic laminate, or rubber having a metallized coating or otherwise rendered electrically conductive. The belt 13 is mounted on and rotated by pulleys 10, 11 and 12, which are rotatably mounted cross-wise in the housing 7, the pulley 10 being mounted in a top forward portion of the housing 7, with the rotational axis thereof generally level with the highest portion of the casing 4, the pulley 11 being mounted in a top rear portion of the housing 7, generally level with the pulley 10, and the pulley 12 being mounted in a lower rear portion of the housing 7, adjacent to the lower rear end of the casing 4, and generally vertically below the pulley 11, whereby, upon rotation of the pulleys 10, 11 and 12 (clockwise in the drawing), the belt 13 is rotated along a path going from the pulley 12, upwards along a curved line following the outer periphery of the casing 4, to and around the pulley 10, along a generally horizontal line to and around the pulley 11, and downwards in a generally vertical line to the pulley 12 again. The belt 13 is contacted at a suitable location by connections to the voltage supply 9, whereby the belt 13 may be charged electrically with opposite polarity to the toner particles for attracting the toner particles. The housing 7 is preferably grounded. Below the pulley 12 there is provided a wiper means 14 which contacts the belt 13 and removes adhering toner particles therefrom. The lower rear portion of the housing 7 is constituted by a large removable reception box portion 15 lying below the outlet **6*b* and wiper means 14.**

In operation, the pulleys 10, 11 and 12 are rotated clockwise at moderate speeds, while the brush 3 is rotated clockwise at high speed. Residual toner particles are removed from the photoreceptor surface 1 by the brush hairs 3', and carried to the outlet **6*b*, where, by the combined effects of centrifugal force, contact of the brush hairs 3' with the bar 8 and compression thereof by the restriction board 5, air and entrained toner particles are driven away from the brush 3. The heavier tone particles fall directly into the reception box portion 15. The lighter toner particles are carried upwards by the air circulating back to the inlet 6*a* through a path S. While being thus carried towards the inlet 6*a*, the toner particles are attracted and adhere to the charged belt 13, which carries the particles downwards to the wiper means 14. The toner particles adhering to the belt 13 pile up to some extent at the location of the wiper means 14, and then fall under gravity into the reception box portion 15. At the same time clean air is drawn into the inlet 6*a***, as described earlier.

From the foregoing description, it has now become clear that, according to the first embodiment of the present invention, the rotating cleaning brush 3 acts as a kind of fan causing an air flow which removes toner particles adhering to the brush hairs 3' and the removed toner particles are adapted to be attracted by the casing 4 charged with opposite polarity to the toner particles by friction between the brush hair 3' and the casing 4, thus requiring no separate filter bag for dust collection or vacuum device. As the toner particles adhering to the cleaning brush 3 can be removed by the circulating air flow alone, durablity of the brush hair 3' is much improved.

Furthermore, the provisions of the external voltage supply 9 for the casing 4 and the bar 8 contacting the brush hair 3' close to the outlet gap **6*b* are effective for better collection of the toner particles removed from the photoreceptor surface 1.**

In the second embodiment according to the present invention, in addition to the functions as described in the above first embodiment, the attraction and disposal of the toner particles are carried out by a continuous belt 13 of electrically conductive material mounted on and rotated by a plurality of rollers, and connected to the voltage supply 9 so as to be charged with opposite polarity to the toner particles. Since the toner particles adhering to the surface of the belt 13 are adapted to be scraped off by the wiper means 14 contacting the belt 13 as the belt 13 rotates, it is not necessary to clean the belt 13 specially, resulting in an improved efficiency of toner particle attraction.

As is clear from the above description, the present invention provides a residual toner removing apparatus, which is extremely compact and simple in construction, and has only low power requirements. The invention thus makes it possible to provide a copying apparatus which is smaller, simpler to maintain, and less costly both in initial and in operating costs.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. A residual toner removing apparatus for removing residual toner particles from a photoreceptor surface, said apparatus comprising:

a rotatable cleaning brush mounted for contact with a photoreceptor surface;

a casing surrounding a portion of the periphery of said brush;

a housing enclosing said casing and having associated therewith a restriction board compressing said brush at a position along the circumference thereof upstream from the position whereat said brush contacts a photoreceptor surface;

said restriction board and a first circumferential end of said casing forming therebetween an air outlet leading from within said casing to a chamber between said casing and said housing;

said housing and a second circumferential end of said casing forming therebetween an air inlet leading from said chamber into said casing;

whereby, upon rotation of said brush, toner particles are removed from a photoreceptor surface and carried thereby past said inlet and through said casing to said outlet through which said removed toner particles are expelled into said chamber, and a continuous circulation of air is created from said chamber through said inlet, through said casing with said removed toner particles to said outlet through which said air is expelled with said removed toner particles into said chamber, and back through said inlet; and a surface positioned about a portion of the periphery of said brush, said surface being charged to a polarity opposite that of said toner particles, said surface comprising means for electrically attracting said removed toner particles from said air within said chamber.

2. An apparatus as claimed in claim 1, wherein said casing is formed of an electrically conductive material.

3. An apparatus as claimed in claim 2, wherein said surface comprises an outer peripheral surface of said casing.

4. An apparatus as claimed in claim 3, wherein said casing is tribo-electrically charged to said polarity by being rubbed by said brush during the rotation thereof.

5. An apparatus as claimed in claim 3, further comprising external voltage source means connected to said casing for charging said casing to said polarity.

6. An apparatus as claimed in claim 1, wherein said surface comprises an electrically conductive endless belt driven along a path adjacent an outer peripheral surface of said casing.

7. An apparatus as claimed in claim 6, further comprising external voltage source means connected to said belt for charging said belt to said polarity.

8. An apparatus as claimed in claim 7, wherein said casing is formed of an electrically insulating material.

9. An apparatus as claimed in claim 1, wherein said housing is electrically grounded.

10. The improvement claimed in claim 1, further comprising means, positioned midway of said outlet and in the path of said brush, for shaking loose any of said removed toner particles adhering to the bristles of said brush.

11. The improvement claimed in claim 1, wherein said housing further comprises well means positioned below said outlet for accumulating a portion of said removed toner particles expelled therefrom.

12. The improvement claimed in claim 11, wherein said housing further comprises well means positioned below said inlet for accumulating a portion of said removed toner particles.

13. The improvement claimed in claim 12, wherein said casing further comprises first and second catchment means positioned above said outlet and said inlet, respectively, for accumulating a portion of said removed toner particles.

14. The improvement claimed in claim 13, wherein said first and second catchment means are respectively L-shaped and U-shaped.

15. In a residual toner removing apparatus for removing residual toner particles from a photoreceptor surface, said apparatus being of the type including a rotatable cleaning brush mounted for contact with a photoreceptor surface, a casing surrounding a portion of the periphery of said brush, a housing enclosing said casing and forming therebetween a chamber, and said housing and casing defining therebetween an air outlet leading from said casing to said chamber and an air inlet leading from said chamber to said casing; the improvement comprising:

a restriction board connected to said housing and compressing said brush at a position along the circumference thereof upstream from the position whereat said brush contacts a photoreceptor surface;

whereby, upon rotation of said brush, toner particles are removed from a photoreceptor surface and carried thereby past said inlet and through said casing to said outlet through which said removed toner particles are expelled into said chamber, and a continuous circulation of air is created from said chamber through said inlet, through said casing with said removed toner particles to said outlet through which said air is expelled with said removed toner particles into said chamber, and back through said inlet; and an electrically conductive endless belt driven along a path adjacent an outer peripheral surface of said casing, said belt being charged to a polarity opposite that of said toner particles, said belt comprising means for electrically attracting said removed toner particles from said air within said chamber.

16. The improvement claimed in claim 15, further comprising wiper means positioned in contact with said belt for removing therefrom toner particles adhered thereto.

17. The improvement claimed in claim 16, further comprising a toner particle collection box removably positioned in said housing at a position below said wiper means.

18. The improvement claimed in claim 15, wherein said housing is electrically grounded.

19. The improvement claimed in claim 15, further comprising external voltage source means connected to said belt for charging said belt to said polarity.

20. The improvement claimed in claim 15, further comprising means, positioned midway of said outlet and in the path of said brush, for shaking loose any of said removed toner particles adhering to the bristles of said brush.

* * * * *